United States Patent [101]

Hall

[11] 4,052,814

[45] Oct. 11, 1977

[54] HOOP GUIDE ROD AND HOOP ROLLING GAME APPARATUS

[76] Inventor: Steve Hall, R.R. No. 2 Box 225, Walton, Ky. 41094

[21] Appl. No.: 669,157

[22] Filed: Mar. 22, 1976

[51] Int. Cl.[2] ..... A63H 33/02

[52] U.S. Cl. ..... 46/220

[58] Field of Search ..... 46/61, 114, 205, 220

[56] References Cited

U.S. PATENT DOCUMENTS

| | | | |
|---|---|---|---|
| 465,950 | 12/1891 | Rowe | 46/220 |
| 3,475,855 | 11/1969 | Edwards | 46/220 |

*Primary Examiner*—Louis G. Mancene
*Assistant Examiner*—Robert F. Cutting
*Attorney, Agent, or Firm*—Melville, Strasser, Foster & Hoffman

[57] ABSTRACT

A novel hoop for use with a game apparatus of the type comprising a circular hoop and a rod for rolling and guiding the same is disclosed. The novel hoop includes a weighted plate-like member captively held within an outer circular rim by means of at least two wheels rotatably mounted thereon. As the outer rim is rotated, such as by rolling it along the ground, the wheels travel along the inside diameter of the outer circular rim and, in combination with the weight, prevent rotation of the plate-like member. In another embodiment of the invention means are disclosed for coupling, in coplanar relationship and for independent rotation, any desired number of circular rims.

5 Claims, 11 Drawing Figures

HOOP GUIDE ROD AND HOOP ROLLING GAME APPARATUS

The apparatus of the present invention relates generally to hoop rolling games of the type comprising a circular goop and a rod for rolling and guiding the same.

It has long been known in the prior art to provide an elongated rod which includes at one end a handle adapted to be grasped by an operator and at the other end means designed to engage a circular hoop. By proper manipulation of the rod, the circular hoop may be rolled along the ground and guided along an infinite variety of circuitous paths. Game apparatus of this type, although not particularly popular at the present time, has amused both children and adults probably since the day the wheel was first invented.

It is the primary object of the present invention to revitalize the interest in hoop rolling game apparatus. In this regard, it is an object of the present invention to provide means in combination with conventional circular hoops which would be attractive, particularly to young people.

In particular, it is an object of the present invention to provide means held rotatably captive within an outer circular rim and which presents an attractive visual manifestation to the game apparatus operator. It is a further object of the present invention to provide a circular hoop which produces an engrossing sound as it is guided along the ground.

Yet another object of the present invention is to provide means whereby any desired number of circular hoops may be coupled together in coplanar relationship and for independent rotation.

Other objects and advantages of the present invention will become apparent during the course of the following description and with reference to the accompanying drawings wherein FIG. 1 is a perspective view showing a guide rod engaging the circular rim of one embodiment of the improved hoop construction of the present invention.

Figure 1:
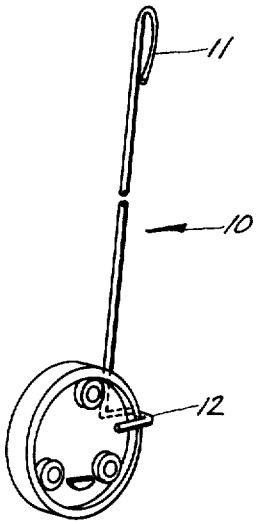

Referring now to the drawings, and particularly to FIG. 1, an elongated guide rod 10 having a handgrip portion 11 and a U-shaped hoop engaging portion 12 is shown in association with one embodiment of the improved hoop construction of the present invention. It will be appreciated that by properly manipulating guide rod 10, whose design and construction is old and well known in the art, an operator may roll and guide the hoop along the ground at his individual discretion. Furthermore, although shown in association with one embodiment of the present invention, it will be appreciated that guide rod 10 may also be used in association with the various other embodiments of the present invention described below.

Figure 2:
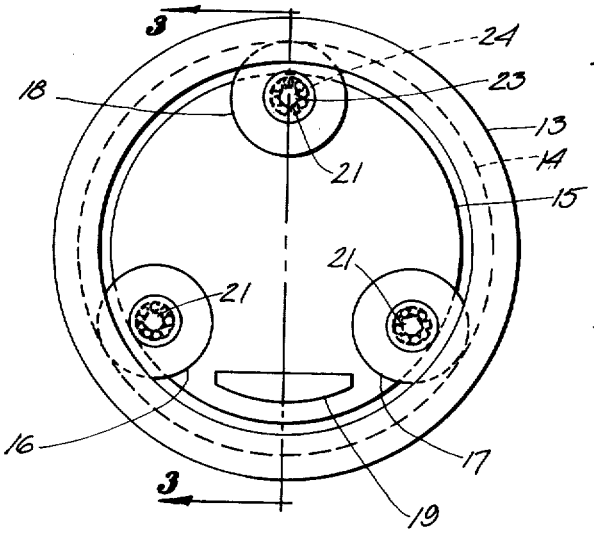
FIG. 2 is a side elevation view of the improved hoop construction shown in perspective in FIG. 1.
Figure 3:
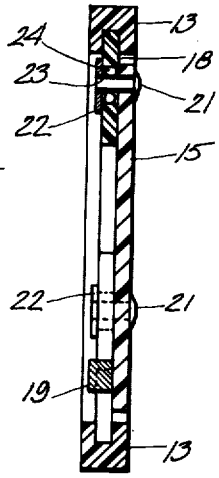
FIG. 3 is a cross sectional view of the hoop shown in FIG. 2 taken along line 3—3 thereof.

Referring to FIGS. 2 and 3, there is illustrated one embodiment of the improved hoop construction of the present invention. The hoop comprises an outer circular rim 13 having an annular groove 14 extending circumferentially about the inside diameter thereof. A plate-like member 15, in this case a circular disc, is captively held within the inside diameter of circular rim 13 by means of wheels 16, 17 and 18 and includes a weight 19 mounted near the periphery thereof. Wheels 16, 17 and 18, which are mounted on plate-like member 15 for travel within annular groove 14, may be secured thereto, for example, by means of screws 21 and mating nuts 22. Screws 21 carry sleeves 23 which, in association with wheels 16, 17 and 18, form annular races for maintaining a plurality of ball bearings 24.

It will be appreciated that as circular rim 13 is rotated, such as by rolling the hoop along the ground, weight 19 will cause wheels 16, 17 and 18 to travel within annular groove 14 so as to substantially prevent rotation of plate-like member 15 and to retain weight 19 in the position shown in FIG. 2. In other words, as the rotation of circular rim 13 attempts to displace weight 19, the counterbalancing gravitational forces acting on weight 19 will cause wheels 16, 17 and 18 to travel within annular groove 14 to stabilize the position of weight 19. Travel of wheels 16, 17 and 18 within annular groove 14 is facilitated by the ball bearing mounting of the wheels which allows free rotation thereof about screws 18 and reduces the frictional resistance between the wheels and annular groove 14. It is thus seen that as rim 13 is rotated, wheels 16, 17 and 18 continuously travel within annular groove 14 to prevent rotation of plate-like member 15 thereby producing an eye-catching and appealing manifestation.

Figure 4:
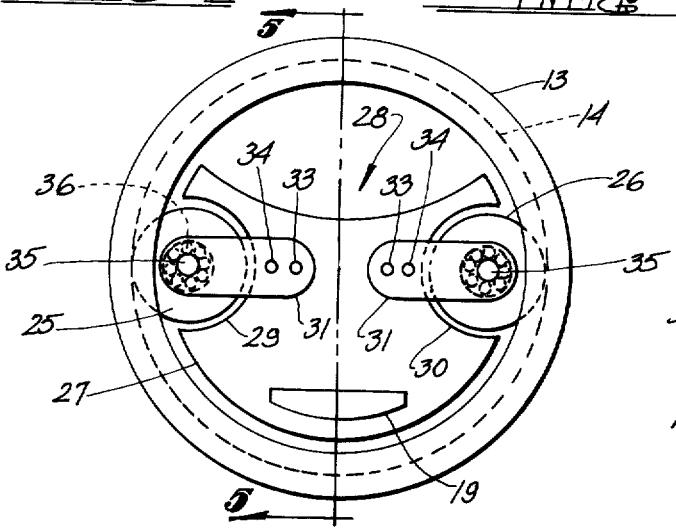
FIG. 4 is a side elevation view of a second embodiment of the improved hoop construction of the present invention.
Figure 5:
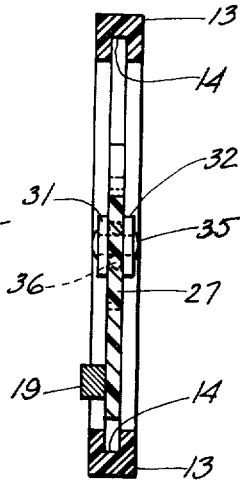
FIG. 5 is a cross sectional view of the hoop shown in FIG. 4 taken along line 5—5 thereof.

Although structurally somewhat different, the hoop embodiment shown in FIGS. 4 and 5 is operationally substantially identical to the embodiment previously discussed in connection with FIGS. 2 and 3. As before, a plurality of wheels, in this case two wheels 25 and 26, are mounted on a plate-like member 27 for travel within annular groove 14 of outer rim 13. And, as in the FIG. 2 embodiment, a weight 19 is mounted near the periphery of plate-like member 27 to stabilize the latter during rotation of the rim 13.

As most clearly shown in FIG. 4, plate-like member 27 includes a cut-out portion at 28 and two cut-out portions 29 and 30 adapted to receive respectively wheels 25 and 26. Wheels 25 and 26 are mounted on plate-like member 27 for travel within annular groove 14 by means of brackets 31, 32. Brackets 31, 32 are secured to plate-like member 27 by screws 33, 34 and a screw 35 extends through brackets 31, 32 and wheels 25, 26. A plurality of ball bearings 36 are provided about screws 35 to facilitate rotation of wheels 25 and 26.

Figure 6:
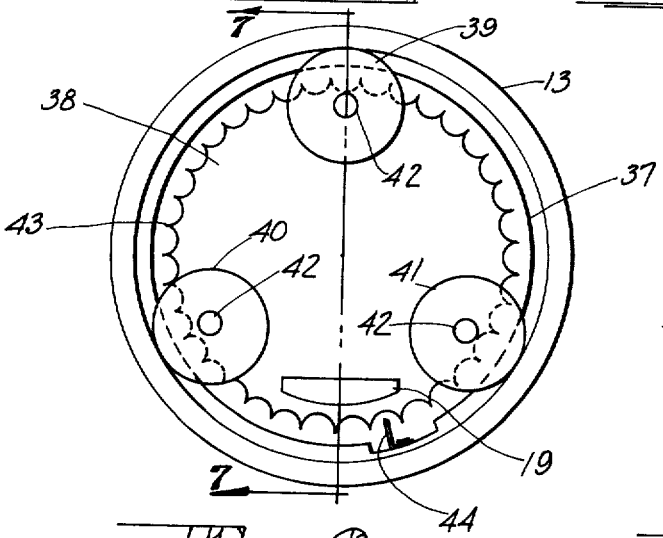
FIG. 6 is a side elevation view of another embodiment of the improved hoop construction of the present invention.
Figure 7:
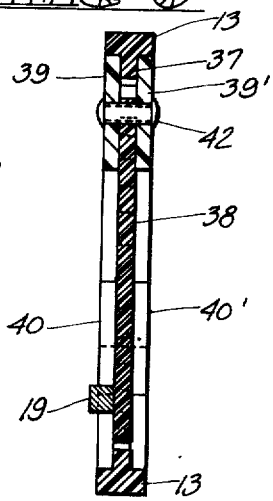
FIG. 7 is a cross sectional view of the hoop shown in FIG. 6 taken along line 7—7 thereof.

FIGS. 6 and 7 show a further embodiment of the hoop construction of the present invention. Here, circular rim 13 includes an annular rib 37 extending from and circumferentially about the inside diameter thereof. Plate-like member 38 is mounted within circular rim 13 by three pairs of coaxial wheels 39—39', 40—40' and 41—41'. Each coaxial pair of wheels is mounted on plate-like member 38 in straddling relationship with annular rib 37 for travel about the inside diameter of circular rim 13. Although coaxial wheel pairs 39—39', 40—40' and 41—41' are shown mounted to plate-like member 38 by means of screws 42, it will be apparent that ball-bearing races such as previously discussed could also be included to facilitate rotation.

With particular reference to FIG. 6 it will be noted that plate-like member 38 is characterized by a scalloped periphery exhibiting a plurality of scallops 43. Also, a resilient spring plate 44 is fastened to an indented segment of annular rib 37 and extends therefrom toward plate-like member 38. As previously explained, plate-like member 38 is maintained substantially non-rotative during rotation of circular rim 13. Therefore, as circular rim 13 is rotated resilient spring plate 44 is caused to traverse scallops 43 whereby a clicking sound will be generated by the hoop.

It has been found that the attractiveness of hoop rolling means, particularly to younger people, is significantly increased by providing means whereby two or more hoops may be coupled together. Accordingly, FIGS. 8 and 9 show two means whereby a plurality of circular rims 13 may be connected together.

Figure 9:
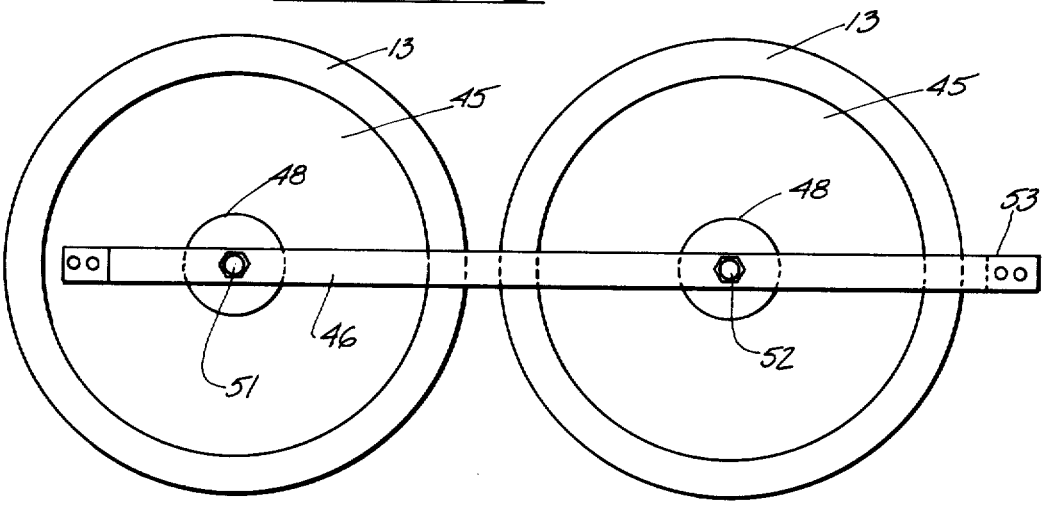
FIG. 9 is a side elevation view of an additional means useful to couple two circular hoops.
Figure 11:
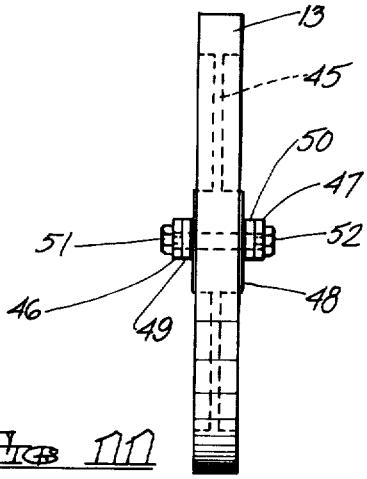
FIG. 11 is an end view of the hoop and coupling means shown in FIG. 9.

In FIGS. 9 and 11 a pair of circular rims 13 having disc-shaped centers 45 are coupled together by means of a pair of opposedly facing and parallel brackets 46 and 47. Brackets 46 and 47 are mounted in straddling relation with a cylindrical member 38 projecting from the centers of discs 45 and spaced therefrom by washers 49 and 50. Appropriate fastening means, such as screws 51 and 52, extend through brackets 46 and 47, washers 49 and 50, cylindrical projectins 48 and discs 45 to securely couple circular rims 13 in coplanar relation wherein each of the rims is independently rotatable. It will further be noted that the ends 53 of brackets 46 and 47 may be recessed for connection to additional similarly recessed portions in the case where it is desired to couple yet another rim 13 to the tandem. It will be recognized that in using the hoops, guide rod 10 may engage either rim 13 to roll and guide the tandem in unison.

Figure 8:
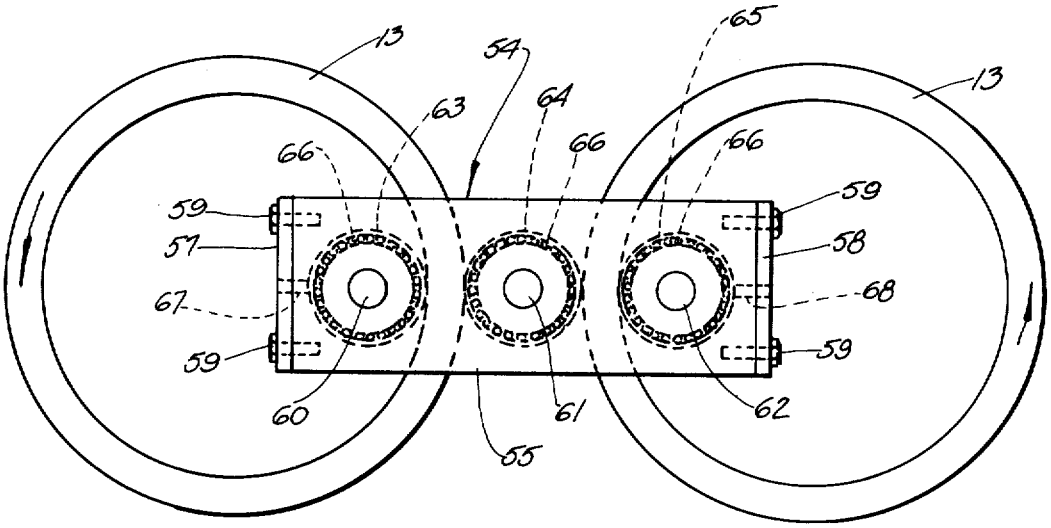
FIG. 8 is a side elevation view of one means of the present invention useful to couple together a pair of circular hoops.
Figure 10:
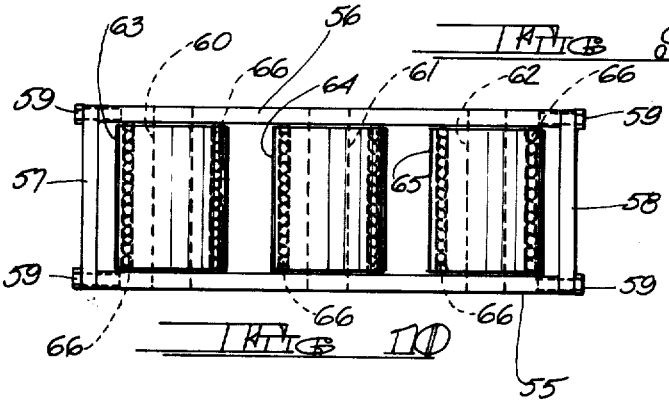
FIG. 10 is a plan view of the coupling means shown in FIG. 8.

FIGS. 8 and 10 show another embodiment of the present invention for coupling at least two circular rims 13. The coupling means comprises a rectangular housing 54 having a pair of side walls 55, 56 and a pair of end walls 57, 58. Appropriate fastening means such as screws 59 are used to maintain the structure of housing 54. Three parallel shafts 60, 61 and 62 extend through side walls 55 and 56 and in parallel relation to end walls 57 and 58. Shafts 60, 61 and 62 have surmounted thereon and coaxial therewith rotatable cylindrical sleeves 63, 64 and 65, respectively, which extend between side walls 55 and 56. Sleeves 63, 64 and 65, whose outside surfaces frictionally bear against circular rims 13, hold a plurality of ball bearings 66 which facilitate rotation of the sleeves with respect to circular rims 13. Also, a pair of loop slots 67 and 68 may be provided to allow for bearing adjustment. It will be appreciated that as rims 13 are caused to rotate in the direction indicated by the arrows, such as by rolling the rim tandem along the ground by guide rod 10, rotatable sleeves 63, 64 and 65 will also, due to their bearing relationship with rims 13, be caused to rotate in the indicated directions.

From the foregoing, it is believed that the invention may be readily understood by those skilled in the art without further description, it being borne in mind that numerous changes may be made in the details disclosed without departing from the spirit of the invention as set forth in the following claims.

I claim

1. In a game apparatus of the type comprising a circular hoop and a rod for rolling and guiding said circular hoop, the improved hoop construction comprising a. a circular rim having an annular groove extending circumferentially about the inside diameter thereof;

b. a plate-like member of smaller dimensions than the inside diameter of said circular rim and having a weight mounted thereon near the periphery of said plate-like member; and c. at least two wheels rotatably mounted on said plate-like member for travel within said annular groove so as to hold said plate-like member captive within said circular rim, whereby during rotation of said circular rim said weight causes said at least two wheels to rotate and to travel within said annular groove so as to substantially prevent rotation of said plate-like member.

2. The improvement according to claim 1 wherein said plate-like member comprises a disc and including a plurality of ball bearings in association with each of said at least two wheels to facilitate rotation thereof and travel thereof within said annular groove.

3. The improvement according to claim 2 wherein said at least two wheels are mounted on said plate-like member in a plane disposed from and parallel to the plane of said plate-like member.

4. The improvement according to claim 2, wherein said at least two wheels are mounted on said plate-like member in co-planar relationship therewith.

5. In a game apparatus of the type comprising a circular hoop and a rod for rolling and guiding said circular hoop, the improved hoop construction comprising:

a. a circular rim having an annular groove extending circumferentially about the inside diameter thereof; and b. a disc-shaped member of smaller dimensions than said rim and seated within said groove for travel thereabout as said circular rim is rotated.

* * * * *